United States Patent [19]

Zandbergen

[11] 4,435,716

[45] Mar. 6, 1984

[54] METHOD OF MAKING A CONICAL SPIRAL ANTENNA

[76] Inventor: Adrian Zandbergen, 28 Camano La., Port Ludlow, Wash. 98365

[21] Appl. No.: 301,925

[22] Filed: Sep. 14, 1981

[51] Int. Cl.[3] ..... H01Q 1/36

[52] U.S. Cl. ..... 343/895

[58] Field of Search ..... 343/895, 872, 873

[56] References Cited

U.S. PATENT DOCUMENTS

| | | | |
|---|---|---|---|
| 2,863,148 | 12/1958 | Gammon et al. | 343/895 |
| 3,184,747 | 5/1965 | Kach | 343/895 |
| 3,858,220 | 12/1974 | Arnow | 343/895 |
| 4,097,867 | 6/1978 | Eroncig | 343/895 |
| 4,163,981 | 3/1978 | Wilson | 343/895 |
| 4,169,267 | 9/1979 | Wong et al. | 343/895 |

*Primary Examiner*—Eli Lieberman

*Attorney, Agent, or Firm*—Ward Brown; Robert W. Beach

[57] ABSTRACT

A length of somewhat resilient yet deformable conductor wire is wound into a tight coil on a generally frustoconical mandrel. The coil is stretched axially inside the bore of an elongated, generally frustoconical antenna blank or casing such that the convolutions of the coil consecutively engage the inner periphery of the casing and are held against further movement. Liquid adhesive injected into one end of the casing in upright position sets to secure the coil to the casing. The resulting conical spiral antenna requires no inner core and is particularly adapted to mobile use such as on a car or a boat.

3 Claims, 9 Drawing Figures

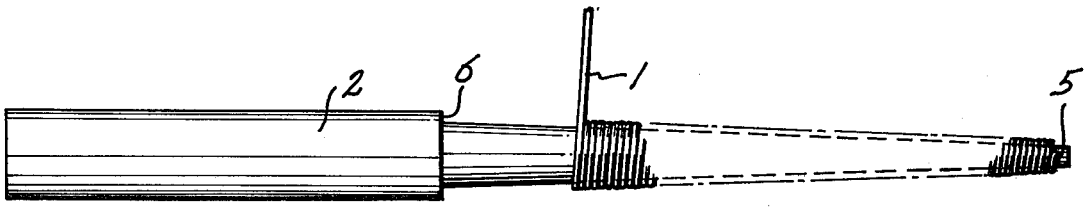
Fig. 1.
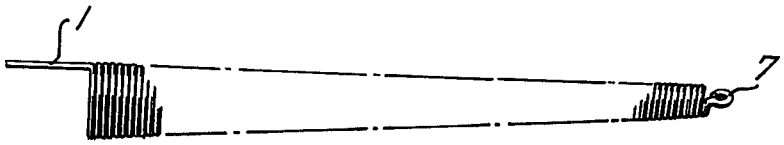
Fig. 2.
Fig. 3.
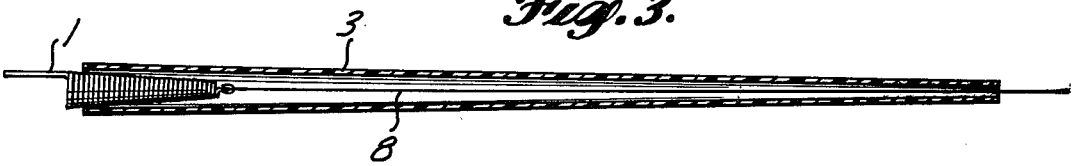
Fig. 4.
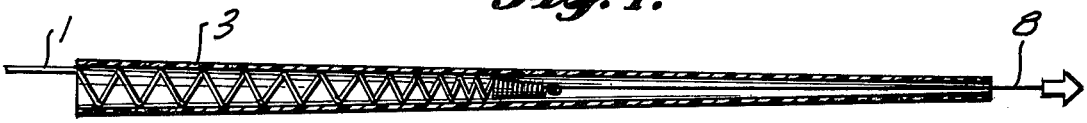
Fig. 5.
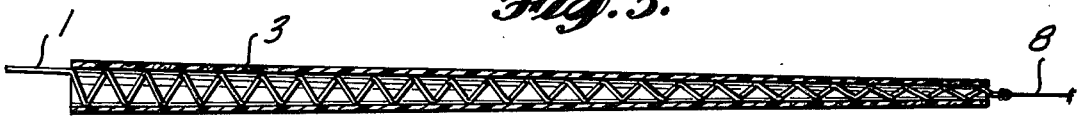
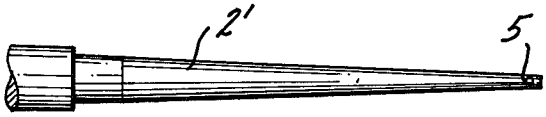
Fig. 8.
Fig. 9.
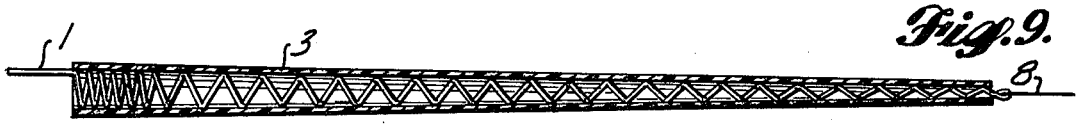

METHOD OF MAKING A CONICAL SPIRAL ANTENNA

BACKGROUND OF THE INVENTION

1. Field of the Invention

The present invention relates to conical spiral antennas for use in radio wave communications.

2. Prior Art

Radio wave communication antennas for mounting on vehicles, such as boats and automobiles, usually are vertical monopoles with a substantially omnidirectional radiation pattern. They must be sturdy so as to withstand the vibrational and accelerational forces applied to them through the vehicle. Preferably they also are light and compact for easy mounting on the vehicle. Monopoles with a broad band characteristic have the advantage of receiving or transmitting radio waves of a fairly broad frequency range.

Conical spiral antennas can have all of the features discussed above and have been utilized in several mobile applications, such as for receiving and transmitting radio waves in the "citizens band" frequency range which is in the neighborhood of 27 megahertz. Typically a small diameter, conically spirally wound antenna conductor wire forms a slightly tapered cone ranging from 1 or 2 feet (0.3 or 0.6 meters) to several feet in height. Particularly for mobile use, the conductor wire must be supported to maintain its shape. In the past such a conductor wire has been sandwiched between a substantially frustoconical inner core and a substantially frustoconical outer protective casing, one or both of which can be plastic material. In manufacture of such an antenna, the preformed inner core is used as a mandrel around which the conductor wire is wound with a desired axial spacing of adjacent spiral convolutions; and the wound core is fitted inside the protective casing. It can be difficult to wind the conductor wire precisely on the inner core, and the resulting antenna may be unacceptably heavy due to the combined weights of the core, the wire and the outer casing.

SUMMARY OF THE INVENTION

The principal object of the present invention is to provide a simple, inexpensive method of making a sturdy, light, compact conical spiral antenna usable in mobile radio wave communications.

This object can be accomplished by winding a conductor wire into a coil, stretching the coil to a desired axial length, and reinforcing the stretched coil to maintain it in stretched condition.

In the preferred embodiment, a somewhat resilient but deformable conductor wire is wound into a tight coil on a tapered mandrel of a length substantially less than the desired length of the finished antenna. The coil is stretched inside the bore of an elongated, hollow, substantially frustoconical casing of plastic material such that the coil convolutions engage the inner periphery of the casing. The stretched coil is secured in position by injecting low viscosity liquid adhesive into one end of the casing in upright position. The adhesive flows over and around the stretched coil of conductor wire, wetting the inner periphery of the casing and forming a fillet of adhesive following the conductor wire, and sets to adhere the coil to the casing.

The resulting antenna includes the outer protective casing with the convolutions of the stretched coil engaged against the inner periphery of the casing and the fillet of adhesive adhering the coil to the casing, without an inner core.

BRIEF DESCRIPTION OF THE DRAWINGS

FIG. 1 is a somewhat diagrammatic side elevation of a mandrel having a conductor wire partially wound on the mandrel in accordance with the method of present invention; and FIG. 2 is a side elevation of the finished coil removed from the mandrel.

FIGS. 3, 4 and 5 are corresponding, somewhat diagrammatic, axial sections of a frustoconical antenna blank or casing illustrating progressive stages of stretching of the conductor wire coil of FIG. 2 inside the casing.

FIG. 8 (on the drawing sheet with FIGS. 1 through 5) is a fragmentary side elevation of an alternative mandrel about which a conductor wire can be wound to form a modified coil usable in the method of the present invention.

FIG. 9 (on the drawing sheet with FIGS. 1 through 5) is a somewhat diagrammatic axial section of a frustoconical antenna blank or casing illustrating stretching of a conductor wire coil inside the casing which coil was formed on the mandrel of FIG. 8.

DETAILED DESCRIPTION

Figure 6:
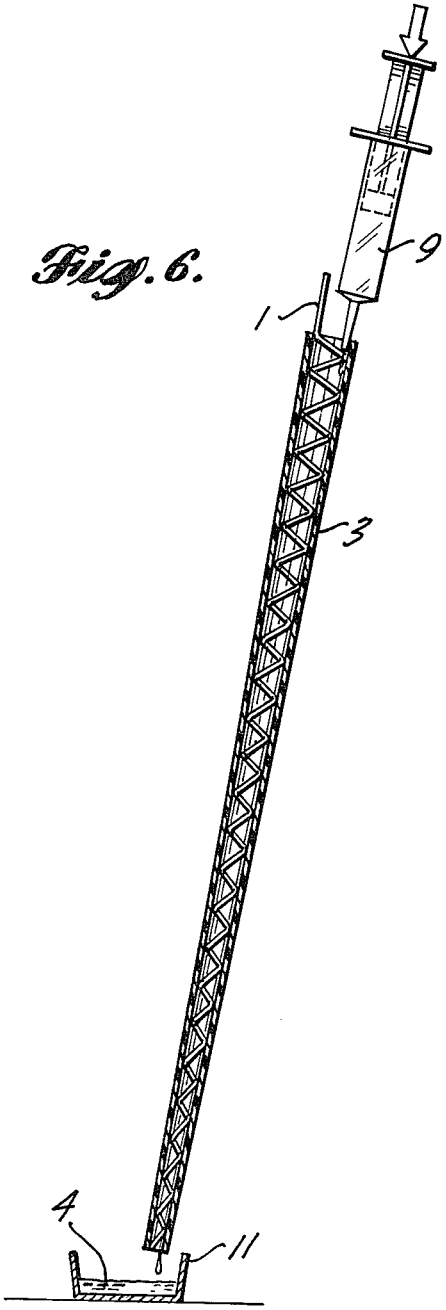
FIG. 6 is a somewhat diagrammatic axial section of a frustoconical antenna blank or casing having an inner conductor wire coil stretched inside the casing in accordance with FIGS. 3, 4 and 5, illustrating injection of liquid adhesive into one end of the casing.

As shown in the drawings, materials used in making a conical spiral antenna in accordance with the method of the present invention include a length of conductor wire 1, preferably somewhat resilient yet deformable material such as substantially pure aluminium wire of a diameter of 0.0625 inch (1.6 mm); a tapered mandrel 2 of rigid material such as aluminum alloy; a preformed, thin-walled, frustoconical antenna blank or casing 3, preferably plastic material such as polyester resin with E-glass woven fiber reinforcement; and a quantity of liquid adhesive 4, preferably of low viscosity and, when set, strong but somewhat flexible such as "Hysol" epoxy manufactured by the Hysol Division of The Dexter Corporation of Olean, N.Y.

In a representative antenna, the casing is tapered uniformly throughout its length of about 100 inches (2.5 meters) from its base diameter of about 1 inch (2.5 cm) to its tip diameter of about ⅜ inch (9.5 mm) and has a wall thickness of about 1/16 inch (1.6 mm). The mandrel has a generally frustoconical wire-receiving portion with base and tip diameters slightly less than the corresponding diameters of the casing base and tip, respectively.

As indicated in FIG. 1, an end portion of the length of conductor wire 1 is threaded through a hole 5 in the tip of the tapered mandrel 2. The wire is tightly wound on the mandrel down to a shoulder 6 at the base of the wire-receiving portion of the mandrel.

After winding of the conductor wire coil, the coil is removed from the mandrel and, as indicated in FIG. 2, the tip end portion of the wire is return bent to form an eye 7. As indicated in FIG. 3, the coil is place in axial alignment with the interior of the casing and with the coil and casing being tapered in the same direction, but the interior of the casing has a much smaller degree of lengthwise taper than the degree of taper of the coil. The major portion of the length of the casing interior is of a cross section greater than the external cross section of the narrower, tip end portion of the coil but smaller than the external cross section of the base end portion of the coil. A threader rod or wire 8 is fed through the tip end of the antenna casing and is fished through the eye of the coil. As indicated in FIGS. 4 and 5, as the threader is pulled back out of the casing the conductor wire coil is stretched lengthwise of the casing to decrease the degree of taper of the coil to match the degree of taper of the casing interior, and to lodge convolutions of the coil against the interior of the casing in spaced relationship lengthwise of the casing.

Figure 7:
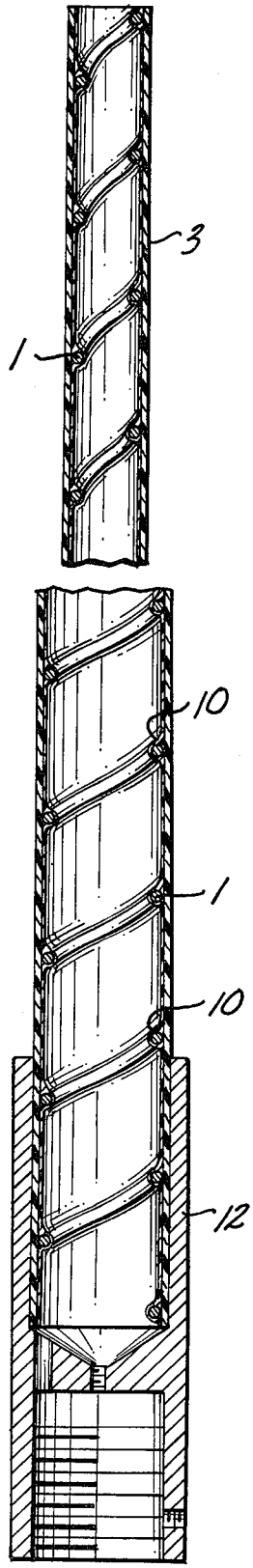
FIG. 7 is an axial section of an antenna formed in accordance with the method of the present invention.

As shown in FIG. 6, with the coil held in stretched condition the antenna casing is maintained upright while liquid adhesive is injected through one end of the casing, such as by use of a syringe 9. The adhesive flows along and over the spiral of the coil, downward along the length of the casing, wetting the inner periphery of the casing to form a thin inner coating of adhesive. Some of the liquid adhesive adheres to the conductor wire and the wetted inner periphery of the casing, as best seen in FIG. 7, forming a continuous thicker fillet 10 following the wire spiral. Excess adhesive drains out the lower end of the casing and can be collected in a tray 11 for use in another antenna.

After the adhesive has set to secure the spiraled conductor wire to the inner periphery of the casing, the antenna can be completed by mounting its larger end portion in a conventional base 12 as shown in FIG. 7. The completed antenna has the protective outer casing 3 with the spaced spiral convolutions engaging the inner periphery of the casing and the fillet 10 of set adhesive maintaining or reinforcing the coil in stretched condition without any inner core being required. Not only is the completed antenna more easily and inexpensively manufactured than an antenna of the conventional sandwich construction, it also is substantially lighter without being substantially weaker.

The axial distance between adjacent convolutions in the stretched conductor wire coil is determined by the difference in their respective diameters, which, in turn, is determined by the taper angle of the mandrel. For example, if the mandrel is tapered only slightly, the number of convolutions per unit length of the casing will be high, whereas for a sharper taper angle of the mandrel the number of convolutions per unit length of the casing will be lower. Since the casing is substantially frustoconical, if the wire-receiving portion of the mandrel also is substantially frustoconical, that is, if it is tapered substantially uniformly from its base to its tip, the axial spacing of the convolutions of the stretched coil inside the casing will be substantially uniform.

The current distribution along the length of a completed antenna will vary depending on the spacing of adjacent coil convolutions in the antenna. A desired axial spacing of adjacent convolutions at a specific location of the completed antenna can be achieved by selecting the appropriate taper angle for the corresponding location of the mandrel. "Top loading" to increase the effective height of the antenna can be achieved by providing more convolutions per unit length toward the tip of the antenna; and "base loading" for adding inductance toward the base of the antenna can be achieved by providing more convolutions per unit length toward the base.

The alternative mandrel 2' shown in FIG. 8 is designed for forming a coil to achieve base loading. The taper angle of the mandrel 2' at its base end portion is substantially less than the taper angle toward the tip portion. In the conductor wire coil wound on such mandrel, the difference in the diameters of adjacent convolutions at the base will be small, whereas the difference in the diameters of adjacent convolutions toward the tip will be substantially greater. As shown in FIG. 9, when the coil is stretched inside the antenna casing, there are substantially more convolutions per unit length at the base than at the tip.

To complete manufacture of the base-loaded antenna, liquid adhesive is injected into the casing and is allowed to set, and the casing is mounted in a conventional base, as in the previously described embodiment.

I claim:

1. The method of making a freestanding antenna which comprises placing a conductor wire coil tapered from a base end portion thereof to a tip end portion thereof in substantially axial alignment with the interior of a preformed elongated casing having an interior tapered in the same direction as the taper of the coil, with the major portion of the casing interior length of a cross section larger than the external cross section of the tip end portion of the coil but smaller than the external cross section of the base end portion coil, and the interior of the casing having a smaller degree of lengthwise taper than the degree of taper of the coil, elongating the coil within the casing and simultaneously thereby decreasing its degree of taper to match the degree of taper of the casing interior and to lodge convolutions of the coil against the interior of the casing in spaced relationship lengthwise of the casing, and bonding the elongated coil to the interior of the casing.

2. The method defined in claim 1, including bonding the elongated coil to the interior of the casing by forming a substantially continuous fillet of adhesive on the inner periphery of the casing which fillet follows the convolutions of the elongated coil.

3. The method defined in claim 1 or 2, including bonding the stretched coil to the inner periphery of the casing by injecting liquid adhesive into one end of the casing while it is maintained upright such that at least some of the adhesive follows downward along the coil convolutions, and allowing the adhesive to set.

* * * * *